US010077952B2

(12) United States Patent
Kenney et al.

(10) Patent No.: US 10,077,952 B2
(45) Date of Patent: Sep. 18, 2018

(54) MANIFOLD STRUCTURE FOR RE-DIRECTING A FLUID STREAM

(71) Applicant: Dana Canada Corporation, Oakville (CA)

(72) Inventors: Benjamin A. Kenney, Toronto (CA); Ihab Edward Gerges, Oakville (CA); Andrew Buckrell, Kitchener (CA)

(73) Assignee: Dana Canada Corporation, Oakville, Ontario (CA)

( * ) Notice: Subject to any disclaimer, the term of this patent is extended or adjusted under 35 U.S.C. 154(b) by 556 days.

(21) Appl. No.: 14/701,658

(22) Filed: May 1, 2015

(65) Prior Publication Data

US 2015/0316330 A1 Nov. 5, 2015

Related U.S. Application Data

(60) Provisional application No. 61/987,570, filed on May 2, 2014.

(51) Int. Cl.
*F28F 3/08* (2006.01)
*F28F 9/02* (2006.01)
(Continued)

(52) U.S. Cl.
CPC ..... *F28F 9/02* (2013.01); *F28D 9/0043* (2013.01); *F28D 9/0056* (2013.01); *F28F 9/001* (2013.01);
(Continued)

(58) Field of Classification Search
CPC .... F28F 9/02; F28F 9/001; F28F 13/12; F28F 9/0265; F28F 9/026; F28F 2280/06;
(Continued)

(56) References Cited

U.S. PATENT DOCUMENTS 1,405,831 A 2/1922 Fricker
2,834,582 A 6/1954 Kablitz
(Continued)

FOREIGN PATENT DOCUMENTS

CN 101363354 A 2/2009
DE 19853455 A1 6/1999
(Continued)

OTHER PUBLICATIONS

FR 2877080 A1—Machine English Translation.*
(Continued)

*Primary Examiner* — Jianying Atkisson
*Assistant Examiner* — Jose O Class-Quinones
(74) *Attorney, Agent, or Firm* — Marshall & Melhorn,LLC

(57) ABSTRACT

A manifold structure for re-directing a fluid stream between first and second ends of a manifold cavity for delivering or discharging a fluid to or from a corresponding fluid transmitting device, such as a heat exchanger is disclosed. In particular, a a flow box enclosing a fluid transmitting device is disclosed wherein an incoming or outgoing fluid is re-directed between first and second directions when being delivered to or discharged from the enclosed fluid transmitting device In one embodiment, the manifold structure includes a first curved surface having a concave curvature for redirecting a fluid stream from a first direction to a second direction. In another embodiment, the manifold structure includes a second curved surface having a convex curvature that is disposed in facing, spaced-apart relationship to the first curved surface, the first and second curved surfaces together inducing swirling movement into the incoming or outgoing fluid stream.

16 Claims, 13 Drawing Sheets

(51) Int. Cl.
*F28F 9/00* (2006.01)
*F28F 13/12* (2006.01)
*F28D 9/00* (2006.01)

(52) U.S. Cl.
CPC ..... *F28F 9/026* (2013.01); *F28F 9/0265* (2013.01); *F28F 13/12* (2013.01); *F28F 2009/029* (2013.01); *F28F 2280/06* (2013.01); *Y10T 137/87265* (2015.04)

(58) Field of Classification Search
CPC .... F28F 9/0224; F28F 9/0219; F28F 2250/10; F28F 2250/102; F28F 2009/222; F28F 2250/02; F28F 9/0234; F28F 9/0248; F28F 9/0263; F28F 9/165; F28F 9/027–9/0275; F28F 9/028–9/0282; F28D 9/0043; F28D 9/0056; F28D 7/1615; F28D 7/1623; Y10T 137/87265; F02B 29/04; F02B 29/0462; F02B 29/0456; F23L 15/02; B60H 1/025; F01P 2060/02; F02M 26/27; F02M 26/28; F02M 26/31; F02M 26/32
See application file for complete search history.

(56) References Cited

U.S. PATENT DOCUMENTS

| | | | | |
|---|---|---|---|---|
| 3,508,606 | A | 9/1968 | Blanchard et al. | |
| 4,187,090 | A | 2/1980 | Bizzarro et al. | |
| 4,327,802 | A | 5/1982 | Beldam | |
| 4,452,216 | A * | 6/1984 | Patchen, II | F02B 29/0462 123/545 |
| 4,775,006 | A | 10/1988 | Hesse | |
| 4,781,241 | A | 11/1988 | Mesage et al. | |
| 4,823,867 | A | 4/1989 | Pollard et al. | |
| 5,465,783 | A | 11/1995 | O'Connor | |
| 5,515,913 | A | 5/1996 | Sanz | |
| 5,575,329 | A | 11/1996 | So et al. | |
| 5,615,738 | A | 4/1997 | Cameron et al. | |
| 5,896,834 | A | 4/1999 | Gruner | |
| 6,003,594 | A | 12/1999 | Cameron et al. | |
| 6,116,335 | A | 9/2000 | Beamer et al. | |
| 6,182,749 | B1 | 2/2001 | Brost et al. | |
| 6,543,528 | B2 | 4/2003 | Saito et al. | |
| 6,546,996 | B2 | 4/2003 | Hudson et al. | |
| 6,568,467 | B1 | 5/2003 | Ohira et al. | |
| 6,820,682 | B2 * | 11/2004 | Hayashi | B60H 1/025 165/109.1 |
| 6,863,121 | B2 | 3/2005 | Menon et al. | |
| 6,896,037 | B2 | 5/2005 | Leeson et al. | |
| 6,997,250 | B2 | 2/2006 | Dilley et al. | |
| 7,201,213 | B2 | 4/2007 | Leeson et al. | |
| 7,458,340 | B2 | 12/2008 | Takeda et al. | |
| 7,481,262 | B2 | 1/2009 | Leeson et al. | |
| 7,610,949 | B2 | 11/2009 | Palanchon | |
| 8,042,609 | B2 | 10/2011 | Samie et al. | |
| 8,225,852 | B2 | 7/2012 | Wu et al. | |
| 8,276,653 | B2 | 10/2012 | Al-Anizi et al. | |
| 8,365,812 | B2 | 2/2013 | Al-Hadhrami | |
| 8,365,813 | B2 | 2/2013 | Mercz et al. | |
| 8,596,339 | B2 | 12/2013 | Palanchon | |
| 8,720,536 | B2 | 5/2014 | Vaughn et al. | |
| 2003/0116305 | A1 * | 6/2003 | Beddome | F28D 9/0043 165/81 |
| 2006/0219394 | A1 * | 10/2006 | Martin | F28D 9/0043 165/157 |
| 2009/0000577 | A1 | 1/2009 | Miyagawa | |
| 2009/0000777 | A1 * | 1/2009 | Wanni | F28D 9/0075 165/166 |
| 2009/0038563 | A1 | 2/2009 | Takarai | |
| 2011/0088886 | A1 | 4/2011 | Kalbacher et al. | |
| 2011/0132586 | A1 | 6/2011 | Diehl et al. | |
| 2013/0105128 | A1 | 5/2013 | Vanderwees | |

FOREIGN PATENT DOCUMENTS

| | | | | |
|---|---|---|---|---|
| DE | 19902504 | A1 | 8/2000 | |
| DE | 102013207180 | A1 | 10/2014 | |
| FR | 2809170 | B1 * | 7/2004 | F28D 9/0043 |
| FR | 2877080 | A1 * | 4/2006 | F28F 9/02 |
| FR | 2989771 | A1 | 10/2013 | |
| GB | 2088544 | B | 7/1984 | |
| GB | 2309075 | A | 7/1997 | |
| JP | 3271518 | B2 | 4/2002 | |
| WO | 0173366 | A1 | 10/2001 | |
| WO | 2008145437 | A1 | 12/2008 | |
| WO | 2013135546 | A1 | 9/2013 | |

OTHER PUBLICATIONS

FR 2809170 B1—Machine English Translation.*
Canadian Intellectual Property Office, The International Search Report and the Written Opinion of the International Searching Authority, PCT/CA2011/050793; dated Mar. 22, 2012; Canadian Intellectual Property Office, Quebec, Canada.
The State Intellectual Property Office of the People's Republic of China, Notice on the First Office Action, (PCT Application No. PCT/CA2011/050793 in the National Phase in China); dated Dec. 2, 2014; State Intellectual Property Office of the People's Republic of China, China.
International Search Report and Written Opinion for Application No. PCT/CA2015/050372, dated Jul. 30, 2015.

* cited by examiner

MANIFOLD STRUCTURE FOR RE-DIRECTING A FLUID STREAM

CROSS-REFERENCE TO RELATED APPLICATION

This application claims priority to and the benefit of U.S. Provisional Patent Application No. 61/987,570 filed May 2, 2014 under the title "FLOW-PROMOTING MANIFOLD STRUCTURE FOR A HEAT EXCHANGER APPARATUS AND A HEAT EXCHANGER APPARATUS INCORPORATING SAME". The content of the above patent application is hereby expressly incorporated by reference into the detailed description of the present application.

TECHNICAL FIELD

The invention relates to a manifold structure for re-directing a fluid stream as well as to a manifold structure capable of promoting flow distribution of an incoming fluid stream to additional components within an apparatus or system. In particular, the invention relates to a manifold structure for re-directing an incoming and/or outgoing fluid stream and promoting more even flow distribution through a heat exchanger apparatus.

BACKGROUND

Heat exchangers arranged within fluid housings are known and are used for a variety of applications. In general, heat exchangers are often arranged within a fluid housing in order to either immerse the heat exchanger within a fluid or to allow a fluid to flow through the housing across the heat exchanger thereby bringing at least two different fluids into heat transfer relationship with one another. The arrangement of the fluid inlets/outlets on the housing and the overall structure of the housing can affect the fluid flow over and/or through the heat exchanger thereby impacting the overall efficiency and/or performance of the overall heat exchanger apparatus. The arrangement and/or positioning of the heat exchanger within an outer housing can also affect the overall performance of the apparatus in general. This is often apparent when fluid enters the housing in a different direction to which it exits the housing (or vice versa) as directional changes can often result in energy losses and/or increases in pressure drops across the corresponding apparatus. Additionally, the specific location of the fluid inlet on the housing can have an effect as to whether the incoming fluid stream is evenly and/or sufficiently distributed through the fluid channels associated with the corresponding heat exchanger or other apparatus thereby affecting the overall efficiency and performance of the apparatus. Accordingly, the manner in which incoming fluid is directed towards and/or discharged from an enclosed heat exchanger or other suitable component or apparatus is an important consideration when trying to optimize overall heat transfer performance.

Accordingly, there is a need for improved manifold structures for directing and/or distributing incoming and/or outgoing fluid streams, especially in instances where fluid enters a heat exchanger or other suitable apparatus at a different direction to the direction in which it exits the overall assembly or vice versa.

SUMMARY OF THE PRESENT DISCLOSURE

In accordance with an exemplary embodiment of the present disclosure there is provided a manifold structure comprising a manifold cavity for receiving a fluid; a first fluid opening in fluid communication with said manifold cavity, said first fluid opening having a flow axis oriented in a first direction, said first fluid opening located at a first end of said manifold cavity for inletting or outletting said fluid to or from said manifold cavity in said first direction; a second fluid opening in fluid communication with said manifold cavity, said second fluid opening having a flow axis oriented in a second direction that is generally perpendicular to said first direction, said second fluid opening arranged at a second end of said manifold cavity for inletting or outletting said fluid to or from said manifold cavity in said second direction; a first curved surface forming a bottom portion of said manifold cavity generally opposite to said first fluid opening, said first curved surface having a concave curvature; wherein said first curved surface is a flow diverting surface for redirecting fluid flow from either said first or second direction to the other of said first or second direction.

In accordance with another exemplary embodiment of the present disclosure there is provided a heat exchanger apparatus, comprising: a housing defining first manifold cavity and a second manifold cavity and a flow passage interconnecting said first manifold cavity and said second manifold cavity; a first fluid opening formed in said housing in fluid communication with said first manifold cavity and having a flow axis oriented in a first direction; a second fluid opening formed in said housing in fluid communication with said second manifold cavity and having a flow axis oriented in a second direction; a heat exchanger located within the flow passage between the first manifold cavity and the second manifold cavity, the heat exchanger having a plurality of first fluid channels for transmitting a first fluid therethrough in said second direction, and a plurality of second fluid channels for transmitting a second fluid therethrough, the heat exchanger having a first end in fluid communication with said first manifold cavity and a second end in fluid communication with said second manifold cavity; a first curved surface forming a base end of said first manifold cavity generally opposite to said first fluid opening, said first curved surface having a first portion extending towards said first fluid opening and a second portion extending away from said fluid inlet and defining a concave curvature therebetween; wherein said first curved surface is a flow diverting surface for redirecting fluid flow between one of said first fluid opening or said second fluid opening and the other of said first fluid opening and said second fluid opening from said first or second direction to the other of said first or second direction for transmission to or from said first fluid channels of said heat exchanger.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

Figure 1:
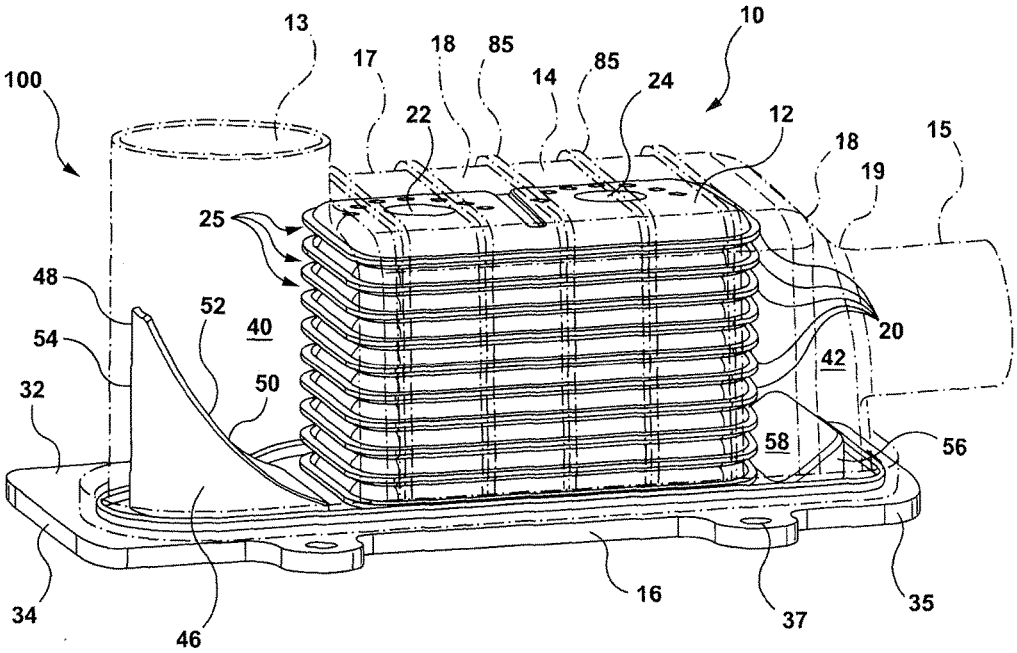
FIG. 1 is a perspective view of a heat exchanger apparatus according to an example embodiment of the present disclosure.
Figure 2:
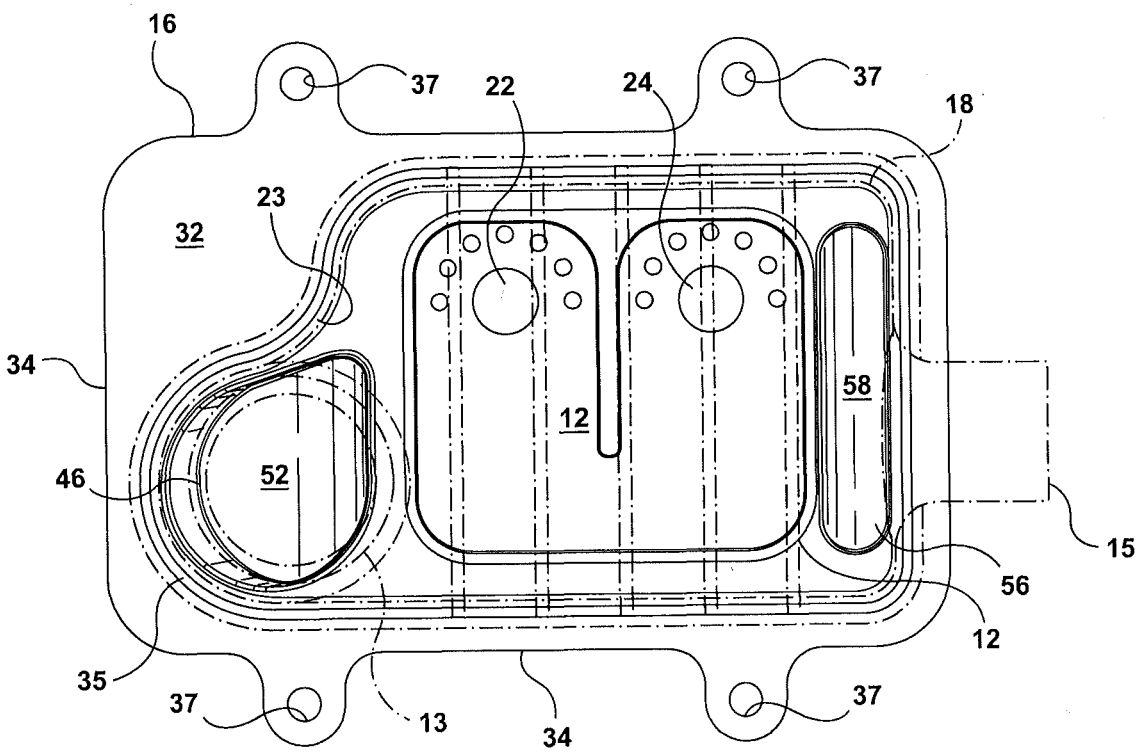
FIG. 2 is a top view of the heat exchanger apparatus of FIG. 1.
Figure 3:
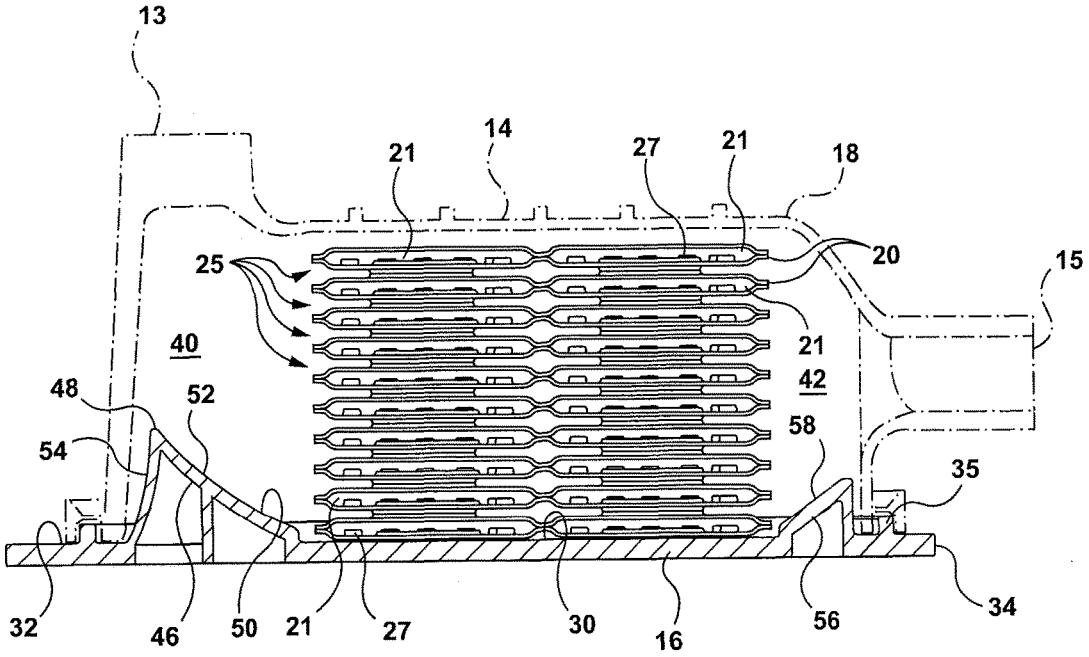
FIG. 3 cross-sectional view of the heat exchanger apparatus of FIG. 1 taken along the longitudinal axis of the heat exchanger apparatus.

Referring now to FIGS. 1-3 there is shown an exemplary heat exchanger apparatus 10 incorporating a manifold structure 100 according to an example embodiment of the present disclosure. For ease of reference, the example embodiment will be described in relation to a heat exchanger apparatus however it will be understood that the technology described may be used in connection with other fluid transmitting devices such as mass transfer or humidifier devices, for example, depending on the particular application.

As shown, the heat exchanger apparatus 10 comprises a heat exchanger (or fluid transmitting device) 12 arranged within a flow box or outer housing 14. The flow box 14 is generally in the form of an external casing or housing comprised of a base plate 16 and a cover portion 18 positioned on top of base plate 16 and enclosing heat exchanger 12 within the combined structure. While the subject exemplary embodiment is described in relation to a heat exchanger 12 being enclosed within the assembly it will be understood, as set out above that the manifold structure 100 and/or flow box 14 may also be used in conjunction with other fluid transmitting devices, such as for example a mass transfer device or humidifier. Accordingly, it will be understood that the present disclosure is not intended to be limited to use with heat exchangers and that other devices having fluid delivered to and discharged therefrom are contemplated within the scope of the present disclosure.

Flow box 14 defines a fluid inlet or first fluid opening 13 generally at one end of the flow box 14 in the top surface 17 of the cover portion 18 and a fluid outlet or second fluid opening 15 arranged at an opposite end of the flow box 14 in an end wall 19 of the cover portion 18 of the flow box 14. Accordingly, the first fluid opening 13 has a flow axis generally perpendicular to the longitudinal axis of the flow box 14 and/or the heat exchanger or fluid transmitting device 12 enclosed within the flow box 14. The second fluid opening 15 is formed in the end wall 19 of the flow box 14 at the opposite end to the first fluid opening 13 and, therefore, has a flow axis generally perpendicular to that of the first fluid opening 13 and generally parallel to and/or in-line with the longitudinal axis of the flow box 14 and/or the heat exchanger 12 (or fluid transmitting device) housed within the flow box 14. In the subject exemplary embodiment the first fluid opening 13 functions as an inlet opening while the second fluid opening 15 functions as an outlet opening however it will be understood that the reverse flow direction is also possible. Accordingly, in operation, a first heat exchange fluid enters the heat exchanger apparatus 10 through first fluid opening 13 and is directed through the manifold structure 100 so as to be brought into contact and heat exchange relationship with the heat exchanger 12 housed within the flow box 14. The fluid flows through heat exchanger 12 in heat transfer relationship with a second fluid flowing through the heat exchanger 12 before exiting the heat exchanger 12 and heat exchanger apparatus 10 through the second fluid opening 15. The overall fluid flow through the flow box 14 therefore undergoes a change in flow direction of at least about 90 degrees between the first fluid opening 13 and the second fluid opening 15. The material of construction of the base plate 16 and cover portion 18 of the flow box 14 is not particularly limited and may be selected depending upon the particular application of the heat exchanger apparatus 10. In some embodiments, the cover portion 18 and/or base plate 16 may be formed of suitable plastic material.

Figure 5:
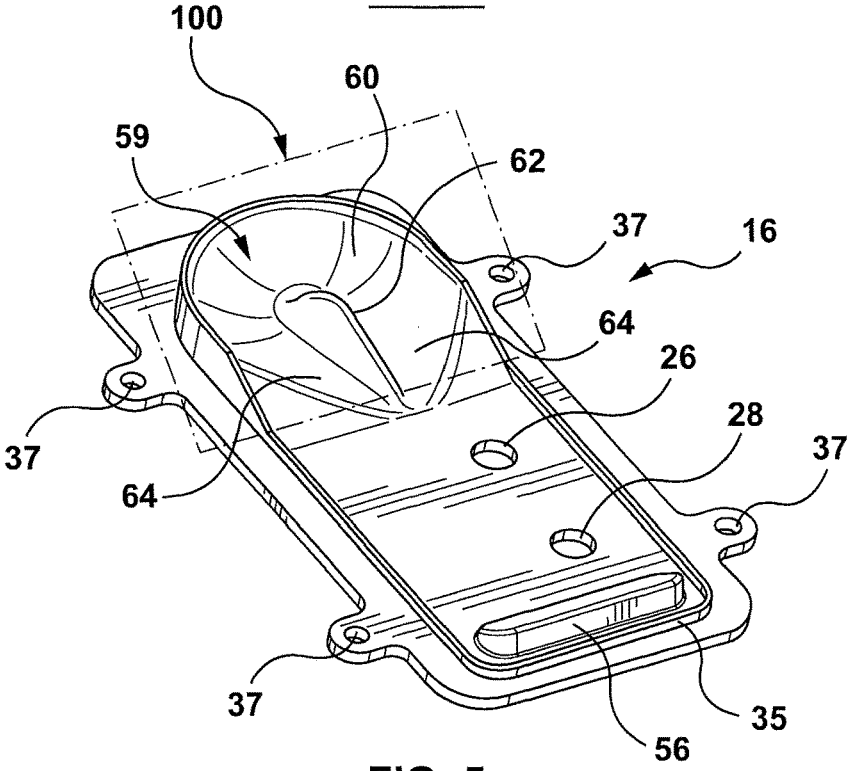
FIG. 5 is a top, perspective view of the base plate of the heat exchanger apparatus of FIG. 4.

Heat exchanger (or fluid transmitting device) 12 may be of any suitable form and, in the subject exemplary embodiment, is in the form of a stacked-plate heat exchanger comprising a plurality of spaced-apart, stacked tube members 20 that each defines an internal fluid flow passage 21 for the flow of second heat exchange fluid therethrough, as shown for instance in FIG. 3. Each tube member 20 has a fluid inlet opening and a fluid outlet opening in communication with the internal fluid flow passage 21, the fluid inlet opening and fluid outlet opening of adjacent tube members 20 being aligned so as to define a fluid inlet manifold 22 and a fluid outlet manifold 24 (shown schematically in FIGS. 1 and 2). Corresponding openings 26, 28 (shown in FIG. 5) may be formed in the base plate 16 (or in the cover portion 18 depending on the particular application) of the heat exchanger apparatus 10 to allow for suitable fluid inlet/outlet fittings (not shown) to be mounted in communication with the fluid inlet and outlet manifolds 22, 24 for inletting and discharging the second fluid through the heat exchanger 12. In some embodiments, the heat exchanger apparatus 10 may be mounted directly in fluid communication with a corresponding fluid source (e.g. such as the housing of an automobile system component). Alternatively, depending upon the exact positioning/arrangement of the inlet and outlet manifolds 22, 24 of heat exchanger 12, the inlet and outlet openings 26, 28 may be formed in the cover portion 18 of the flow box 14.

The spaces formed between the spaced-apart, stacked tubular members 20 form a second set of fluid passages 25 for the flow of the first heat exchange fluid entering the heat exchanger apparatus 10 through first fluid opening 13 to flow through the heat exchanger 12 thereby bringing the first heat exchange fluid into heat exchange relationship with the second heat exchange fluid flowing through the enclosed first set of fluid passages 21. Heat transfer augmenting devices, such as fins, may be located between the stacked, tube members in order to improve heat exchange efficiency and/or increase overall strength of the heat exchanger structure. Alternatively, the stacked tube members 20 may be formed with dimples, ribs or other protuberances 27 formed on the outer or inner surfaces of the tube members 20 in order to achieve similar effects. Turbulizers or other known devices such as dimples or ribs 27 may also be arranged or formed within the internal fluid flow passages 21 in order to increase heat transfer in accordance with principles known in the art. In some embodiments, the tube members 20 may be formed as a unitary structure while in other embodiments they may be formed from mating plate pairs.

Heat exchanger (or fluid transmitting device) 12 is arranged so as to be enclosed within flow box 14. Heat exchanger 12 is positioned on a generally planar central portion 30 of the inner surface 32 of base plate 16 with the cover portion 18 of the flow box 14 being arranged over-top of the heat exchanger 12 and sealing against the upper or inner surface 32 of the base plate 16. In some embodiments the base plate 16 may be formed with a raised lip, or peripheral rim 35 that is inwardly disposed from the peripheral edge 34 of the base plate 16 to provide a sealing surface for engaging with the open end 36 of the cover portion 18. Accordingly, a portion of the base plate 16 extends outwardly beyond the perimeter defined by the cover portion 18 to provide additional mounting surface, if required. Mounting holes 37 may also be formed at spaced apart intervals around the base plate 16 to assist with mounting and/or securing of the heat exchanger apparatus 10 to a corresponding component within an overall system, for example.

A first manifold cavity or space 40 is defined within the cover portion 18 at the inlet or first end of the flow box 14, the first manifold cavity being generally aligned with first fluid opening 13 and being open to and in fluid communication with the open ends of the second set of fluid passages 25 formed in heat exchanger 12. A second manifold cavity or space 42 is defined within the cover portion 18 at the outlet end of the flow box 14, the second manifold cavity 42 being in fluid communication with the outlet ends of the second set of fluid passages 25 in the heat exchanger 12 for receiving the first fluid as it exits the second set of fluid passages 25 before being discharged from the heat exchanger apparatus 10 through second fluid opening 15. In general, it is desirable for incoming fluid to be directed towards the heat exchanger 12 over a large area of the inlet end of the heat exchanger 12 to ensure even and/or optimized fluid distribution through fluid channels 25 of the heat exchanger 12. In order to promote fluid flow towards a large area of the inlet end of heat exchanger 12, first fluid opening 13 is arranged slightly offset with respect to the inlet end of heat exchanger 12 or longitudinal axis of the heat exchanger apparatus as shown most clearly in FIG. 2. As illustrated in the drawings, first fluid opening 13 is formed in the cover portion 18 so as to be positioned at the lower left hand corner of the inlet end of heat exchanger 12 (when viewed from above). Cover portion 18 is also shaped and contoured in order to promote fluid flow from the first fluid opening 13, located generally at one corner of the heat exchanger 12, across the entire end face or inlet end of the heat exchanger 12. More specifically, rather than the cover portion 18 having a generally rectangular, dome-shaped structure, the inlet end of the cover portion 18, as shown in the top view of FIG. 2, is contoured so as to taper inwardly around the first fluid opening 13 before extending or tapering outwardly towards the upper left-hand corner of the heat exchanger 12, the inwardly tapered area 23 of the cover portion 18 forming an indented upper left-hand corner of the cover portion 18, as seen from the top as shown in FIG. 2. The shaping of the cover portion 18 creates an almost, funnel or nozzle-like portion or area of the first manifold cavity 40 in the inwardly tapered area 23 which helps to promote flow distribution from the first fluid opening 13 towards the entire end face or inlet end of the heat exchanger 12 which helps to ensure fluid distribution to fluid channels 25 of heat exchanger 12.

In order to further assist with the re-direction of the first heat exchange fluid entering the heat exchanger apparatus 10 through first fluid opening 13 towards the inlet end of heat exchanger 12 in an effort to ensure adequate flow distribution through fluid channels 25, base plate 16 is provided with a first ramp or inlet ramp 46. As shown in FIGS. 1-3, first ramp 46 has a first end 48 that extends upwardly away from the base plate 16 into the first manifold cavity 40 towards first fluid opening 13 and a second end 50 that slopes downwardly through the first manifold cavity 40 towards heat exchanger 12 (or any other suitable apparatus or device enclosed within the flow box 14). In addition to the downwardly sloping front surface 52, the rear surface 54 of the first ramp 46 may also be shaped or curved so as to correspond to the interior shape or contour of the surface of the cover portion 18 forming the first manifold cavity 40. For instance, in the subject embodiment, the cover portion 18 defines a somewhat circular or cylindrical rear wall of the first manifold cavity 40, the rear surface 54 of the first ramp 46 being curved so as to general correspond to the interior shape of the cover portion 18 forming the first manifold cavity 40. As shown more clearly in FIG. 2, first ramp 46 also gradually slopes towards the inwardly tapered area 23 of the first manifold cavity 40 which helps to further promote fluid distribution through the first manifold cavity 40 towards heat exchanger 12. First ramp 46, therefore, serves as a flow diverter to gradually introduce movement and/or mixing into the fluid stream entering the flow box 14 through first fluid opening 13 so as to re-direct the incoming flow through the approximate 90 degree bend in such a manner so as to possibly reduce and/or avoid energy losses as well as undesirable pressure drops often associated with abrupt changes in flow direction of a fluid stream. First ramp 46 may be formed integrally as part of the base plate 16 or may be formed as a separate component that is then secured to the base plate 16 by any suitable means.

A second or outlet ramp 56 may also be provided within the second manifold cavity 42 on base plate 16 at the outlet or second end of the heat exchanger apparatus 10. The second ramp 56 is generally in the form of an upwardly sloping ramp, the upwardly sloping surface 58 facing the outlet or second ends of the second set of fluid passages 25 of heat exchanger 12 so as to divert and/or redirect the fluid exiting the second set of fluid passages 25 of heat exchanger 12 towards the second fluid opening 15 of the heat exchanger apparatus 10. The second ramp 56 is particularly useful in instances where the second fluid opening 15 of the heat exchanger apparatus 10 is somewhat raised with respect to the bottom of the heat exchanger 12 so that the fluid exiting the lowermost fluid passages 25 can be directed upwards towards the second fluid opening 15. Similarly, the interior surface of the cover portion 18 in the second manifold cavity 42 can be shaped so as to slope towards the second fluid opening 15 in order to assist with directing the fluid exiting the uppermost fluid passages 25 of the heat exchanger 12 towards the outlet 15.

While the first ramp 46 has been described in connection with the first manifold cavity 40 for directing/diverting incoming fluid towards a fluid device enclosed within the flow box 14 with the second ramp 56 being arranged in connection with the second manifold cavity 42 to assist with discharging fluid from flow box 14, it will be understood that the flow direction through the flow box 14 could be reversed with the fluid entering the flow box 14 through the second manifold cavity 42 and exiting the flow box 14 via the first manifold cavity 40, the mixing and/or movement being induced within the outgoing fluid stream in the same manner as described above. Accordingly, it will be understood that the first manifold cavity 40 is not intended to be limited to an inlet manifold cavity and that the described flow direction through the heat exchanger apparatus 10 could be reversed.

While the first manifold cavity 40 has been described as being formed as part of the flow box 14 structure, it will be understood that the first manifold cavity 40 with fluid inlet (or fluid opening) 13 could be formed as a separate component or fitting that is then affixed or suitably joined to a corresponding conventional housing or directly to a fluid transmitting device such as a heat exchanger to assist with the delivery or discharge of a fluid through the associated fluid transmitting device or housing.

Figure 3A:
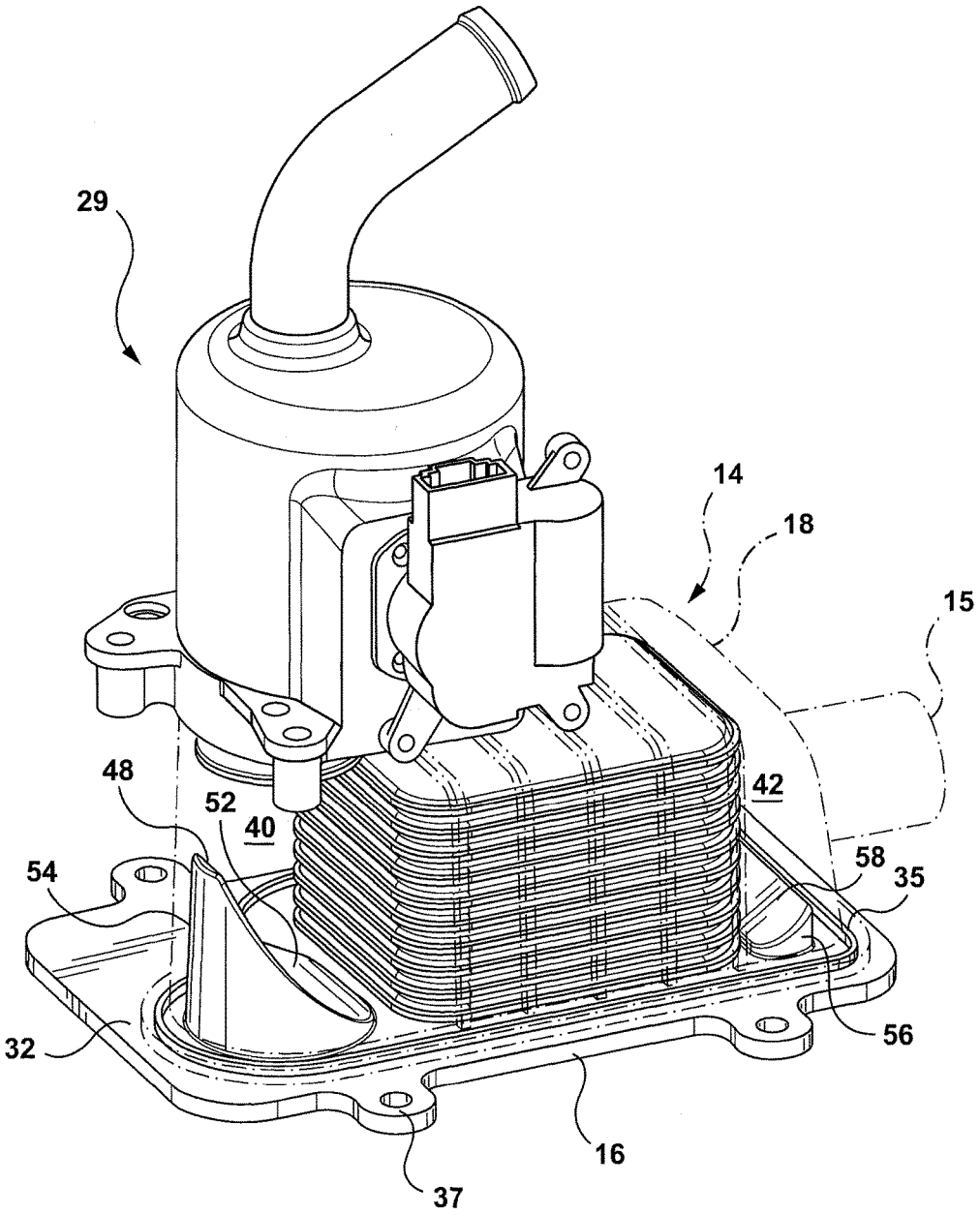
FIG. 3A is a perspective view of the heat exchanger apparatus of FIG. 1 with a control device mounted thereon.
Figure 4:
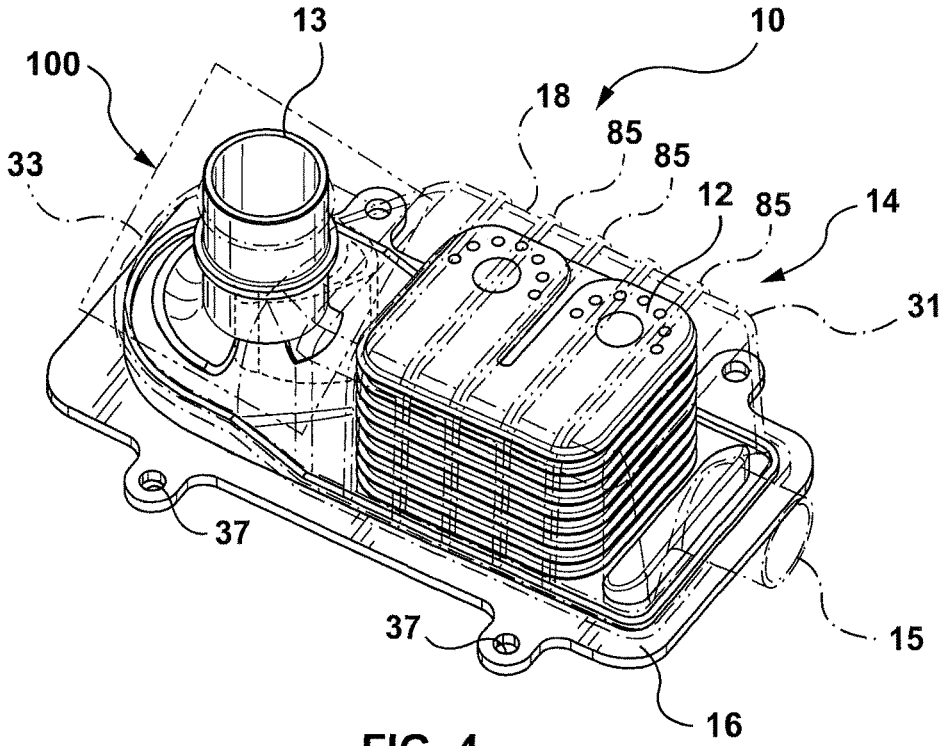
FIG. 4 is a top, perspective view of a heat exchanger apparatus according to another example embodiment of the present disclosure.

In some embodiments and depending upon the particular application of the heat exchanger apparatus 10, it may be desirable to mount a flow control device in conjunction with the heat exchanger apparatus 10. More specifically, a control valve 29 (as illustrated in FIG. 3A) configured to control the source and flow rate of the first heat exchange fluid entering flow box 14 may be mounted on the generally flat top or upper surface of the cover portion 18 in fluid communication with first fluid opening 13. While the control valve 29 may add to the overall package height of the heat exchanger apparatus 10, the positioning of the control device or control valve 29 on the upper surface of the cover portion 18 does not add to the overall length of the heat exchanger apparatus 10 and makes use of the generally flat area provided by the upper surface of the cover portion 18 without requiring further modification of the heat exchanger apparatus 10 so as to provide a specific mounting area or mounting flange.

Referring now to FIGS. 4-9 there is shown another heat exchanger apparatus 10 incorporating a manifold structure 100 according to another exemplary embodiment of the present disclosure. In the subject exemplary embodiment, heat exchanger apparatus 10 is similar to the previously described embodiment in that it too comprises a heat exchanger 12 arranged within a flow box or outer housing 14, the flow box 14 being generally in the form of an external casing or housing comprised of a base plate 16 and a cover portion 18 positioned on top of the base plate 16 and enclosing heat exchanger 12 within the combined structure. However, in this embodiment as shown more clearly in FIG. 5, rather than providing a first ramp 46 having a first end 48 that extends upwardly into the first manifold cavity 40 and having a downwardly sloped second end 52 that extends directly towards the leading or inlet end of the heat exchanger 12 for re-directing the incoming flow in the first direction towards heat exchanger 12 in the second direction, the base plate 16 is shaped so as to provide a generally U-shaped curved depression or half-torus shaped depression 59 within the surface thereof. The generally U-shaped curved depression or half-torus shaped depression 59 forms a curved channel region 60 about a generally central protrusion 62, the curved channel region 60 having respective ends 64 that each extend toward the central planar portion 30 of the base plate where heat exchanger 12 (or other device) is located. In the subject embodiment, the flow box 14 has a slightly different structure than the flow box 14 of the previously described embodiment. More specifically, in the subject embodiment the flow box 14 comprises a generally rectangular portion 31 for housing the stacked-tube or stacked-plate style heat exchanger 12 (or other fluid transmitting device), the generally rectangular portion 31 being integrally formed with a more rounded, dome-shaped end portion 33 that incorporates the manifold structure 100. Accordingly, the flow box 14 is slightly extended as compared to the previously described embodiment with the more rounded end 33 of the flow box 14 forming the first manifold cavity 40 being slightly spaced-apart from leading edge or inlet end of heat exchanger 12. The slight spacing apart of the manifold structure 100 from the leading edge or inlet end of heat exchanger 12 provides some additional space for re-directing the fluid flow entering the first manifold cavity 40 before the fluid impacts or impinges on the leading edge or inlet end of heat exchanger 12. In the reverse flow direction the space or gap between the end of the heat exchanger (or other fluid transmitting device) provides additional space for funnelling the outgoing fluid towards manifold structure 100. It will be understood, however that the specific size of the first manifold cavity 40 and the exact spacing provided between the first manifold cavity 40 and the end edge of the heat exchanger 12 (or other fluid transmitting device) will depend on the particular application of the heat exchanger apparatus 10 as well as any packaging requirements for the overall apparatus 10.

Given the spacing that is provided between the first manifold cavity 40 and the leading edge or end face of the associated heat exchanger 12 (or other suitable device), it will be understood that the first manifold cavity 40 with fluid inlet (or opening) 13 could also be formed as a separate component or fitting that is then affixed or suitably joined to a corresponding flow box or housing or other fluid transmitting device. Accordingly, in some embodiments the manifold structure 100 may be separate to the remaining components of the flow box or heat exchanger apparatus.

In the subject exemplary embodiment, rather than having the first fluid opening 13 offset with respect to heat exchanger 12 as in the previously described embodiment, first fluid opening 13 is arranged centrally within the dome-shaped inlet end 33 of the first manifold cavity. In operation, the first heat exchanger fluid entering the heat exchanger apparatus 10 through the generally centrally-located first fluid opening 13 contacts the central protrusion 62 formed at the base of the first manifold cavity and has a tendency to be split or diffused about the central protrusion 62 causing the fluid to first be directed downwardly along a first portion of the U-shaped channel region 60 before being be directed upwardly along the second portion of the curved or concave walls of the U-shaped channel region 60 formed around the central protrusion 62 as shown somewhat schematically in FIG. 6. The inner surface 63 of the dome-shaped portion 33 of cover portion 18 further promotes the fluid to turn-back on itself so as to be directed back towards heat exchanger 12. Accordingly, the upwards deflection of the fluid flow along the curved, concave surface provided by the channel region 60 and the corresponding dome-shaped inner surface 63 of the inlet portion 33 of cover portion 18 tends to induce a swirling motion into the fluid stream creating desirable fluid dynamics within the first manifold cavity 40 of the flow box 14. The swirling movement or swirl-flow induced within the fluid stream by the shaping of the base plate 16 and the corresponding inlet region 33 of the cover portion 18 helps to direct the fluid stream entering the flow box 14 in the first direction towards heat exchanger 12 without encountering some of the known pressure and/or energy losses often associated with more abrupt changes in flow direction.

The swirl flow created within the first manifold cavity 40 of the manifold structure 100 of flow box 14 may be further enhanced by providing a manifold insert 68 mounted within first fluid opening 13 as well as by specifically adapting the cover portion 18 to further promote the re-direction of the incoming fluid towards the inlet end of heat exchanger 12. As shown most clearly in FIGS. 6 and 7, manifold insert 68 is in the form of a tube having an elongated, generally cylindrical, tubular body 70 extending between opposed first and second ends 72, 74. The generally cylindrical, elongated tubular body 70 has an outer diameter D1 that is sized so as to fit within first fluid opening 13 formed in the cover portion 18 and has a length that allows the insert 68 to extend into the first manifold cavity 40 formed within flow box 14. The first end 72 provides an open end 76 for the inletting of the first heat exchange fluid into the heat exchanger apparatus 10. The second end 74 of the tubular body 70 also provides an open end 80 and is formed with outwardly flared, upwardly curved edges 78 that surround the second open end 74. The overall outer diameter D2 of the second end 74 formed by the outwardly flared, upwardly curved edges 78 is generally less than the overall inner diameter of the dome-shaped first manifold cavity 40 formed by the inner surface of the cover portion 18 of the flow box 14 so as to provide a generally annular-shaped gap 81 therebetween.

Figure 6:
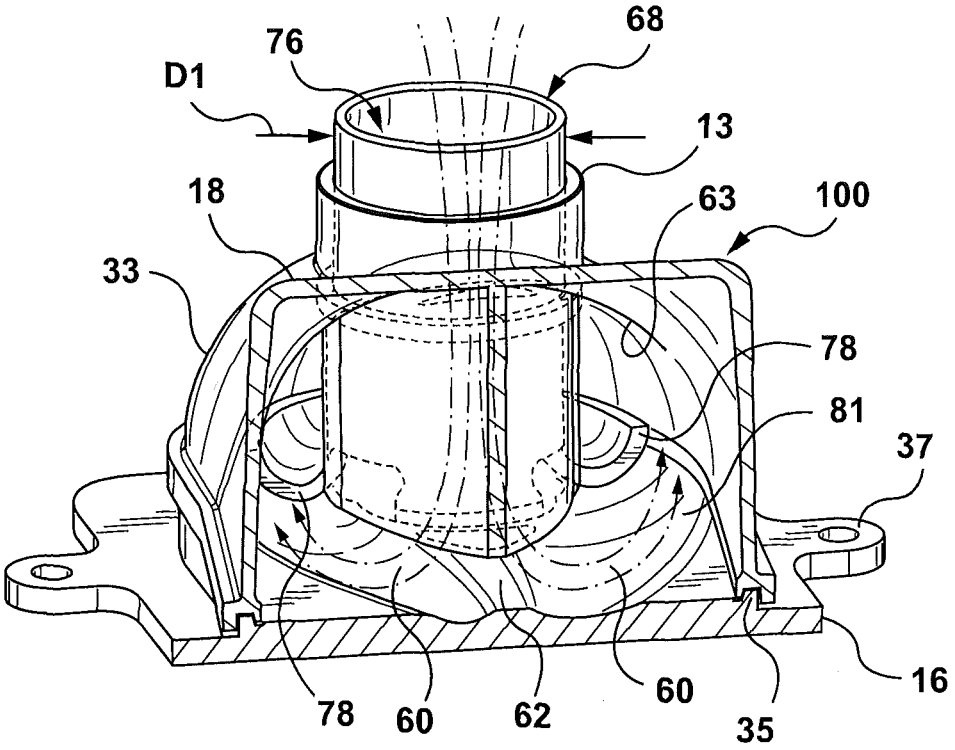
FIG. 6 is a cross-sectional view of the manifold structure of the heat exchanger apparatus of FIG. 4 taken along an axis perpendicular to the longitudinal axis of the heat exchanger apparatus.
Figure 7:
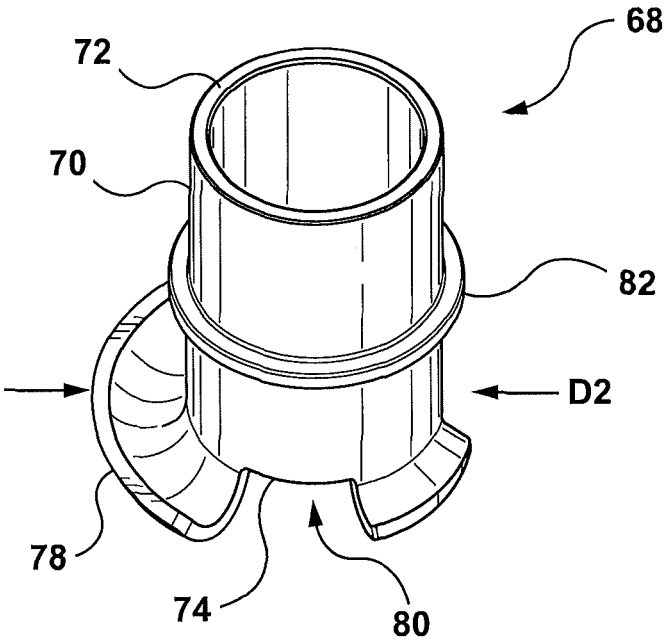
FIG. 7 is a top, perspective view of a component of the manifold structure of FIG. 6.
Figure 8:
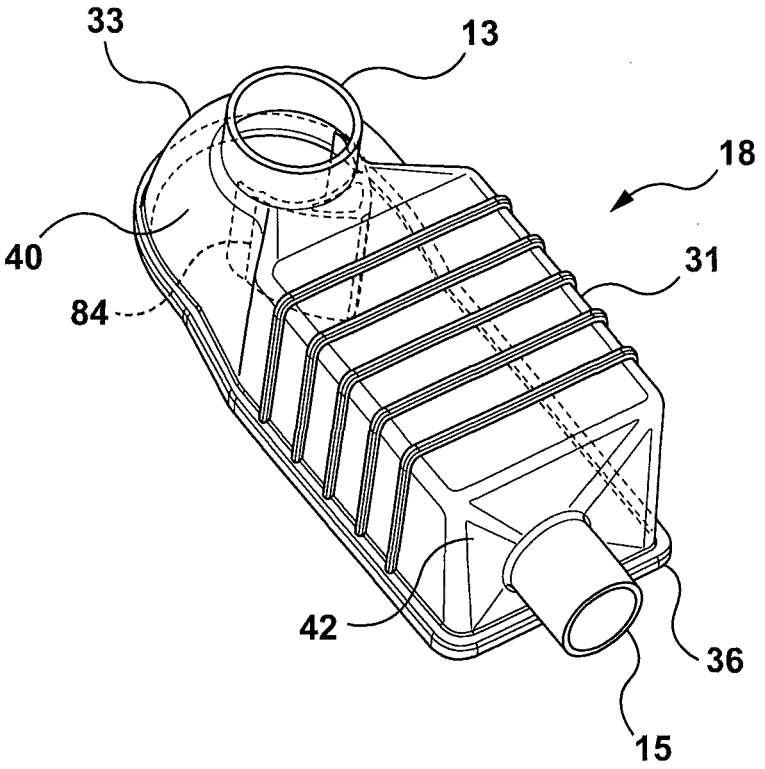
FIG. 8 is a top, perspective view of the cover portion of the heat exchanger apparatus of FIG. 4.
Figure 9:
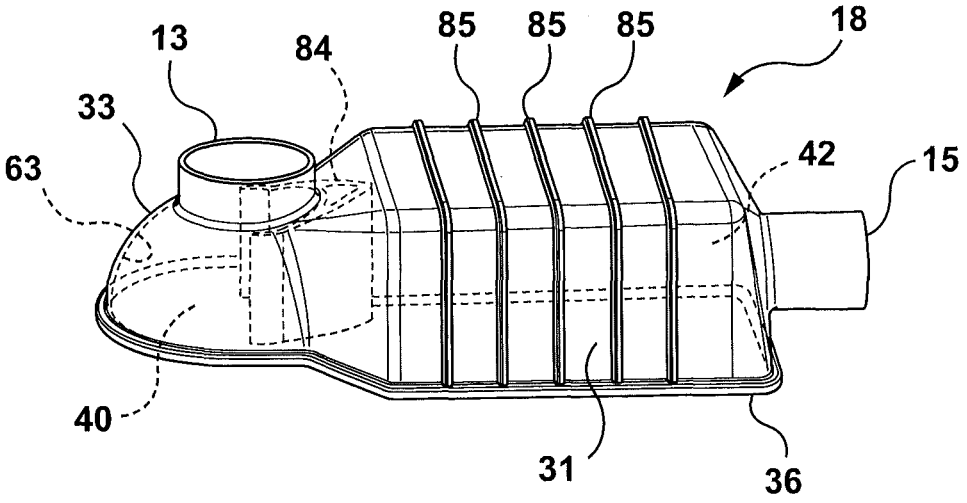
FIG. 9 is a side view of the cover portion of FIG. 8.
Figure 12:
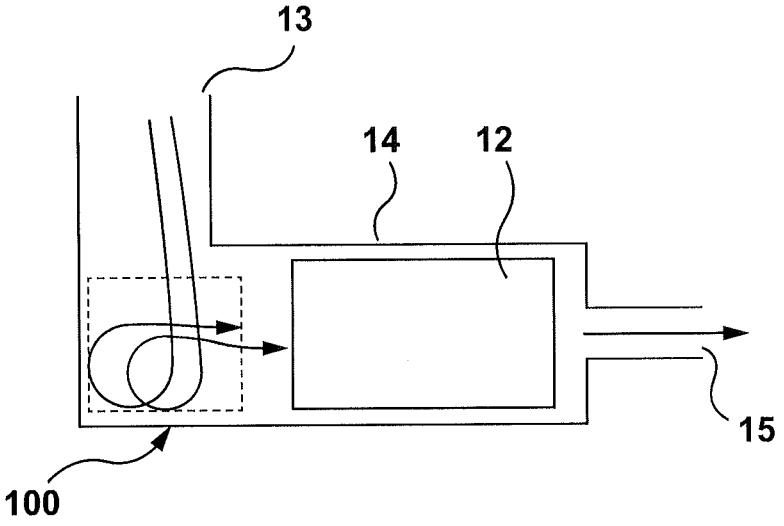
FIG. 12 is a schematic illustration of fluid flow through the heat exchanger apparatus of FIG. 4.
Figure 13:
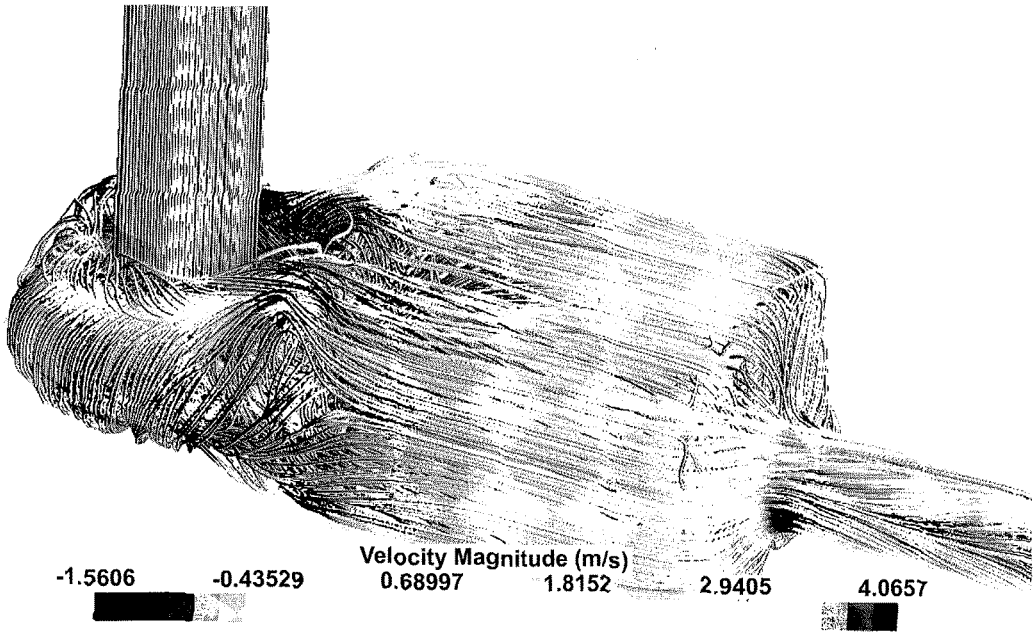
FIG. 13 is a fluid model of the heat exchanger apparatus according to the present disclosure illustrating the fluid flow through the apparatus.
Figure 14:
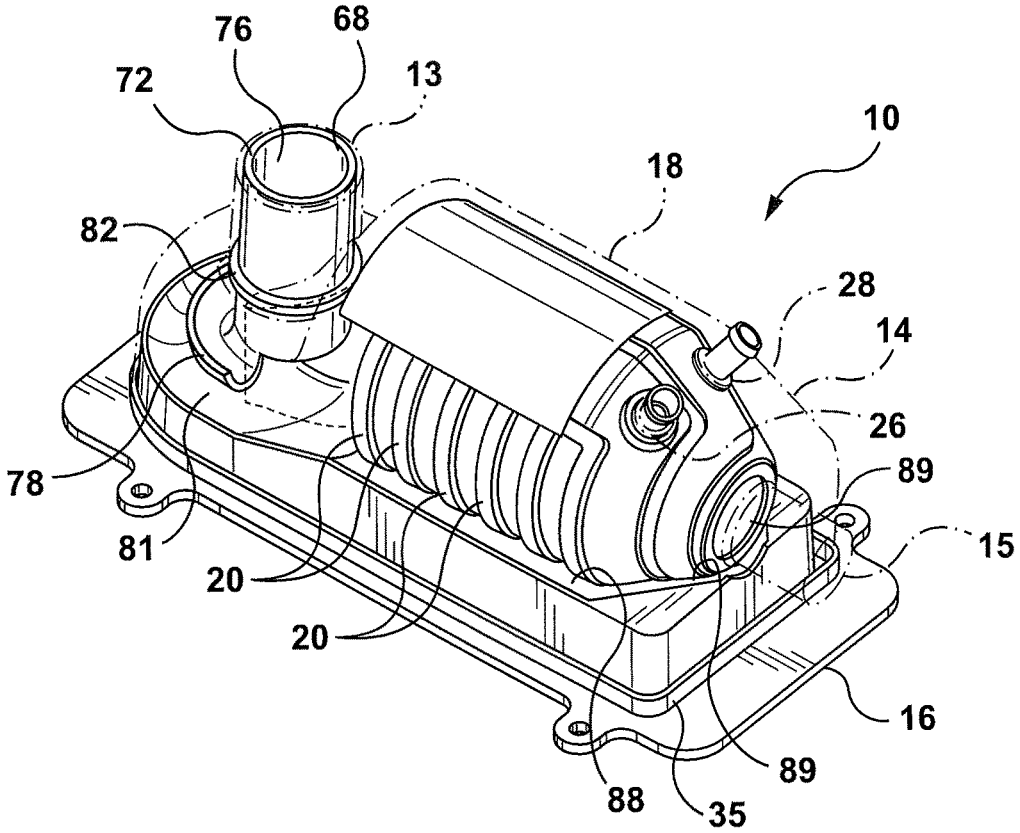
FIG. 14 is a top, perspective view of a heat exchanger apparatus according to another example embodiment of the present disclosure.
Figure 15:
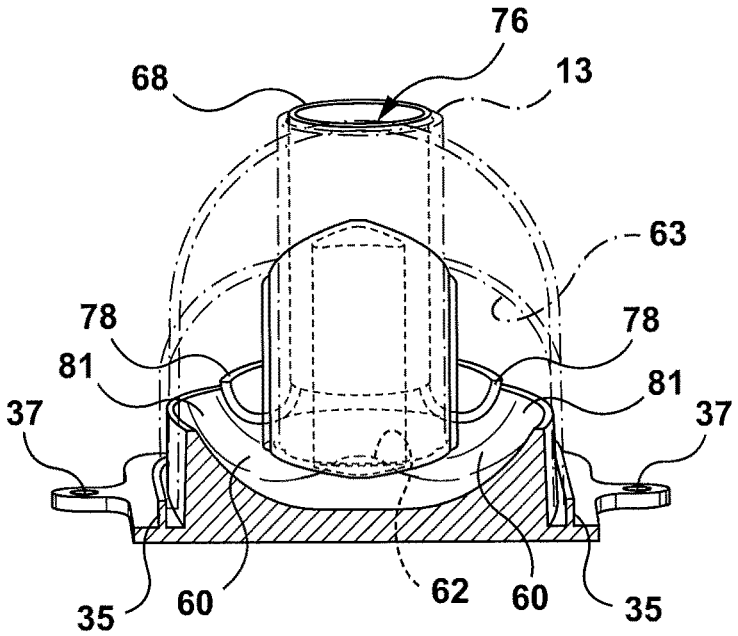
FIG. 15 is a cross-sectional view of the manifold structure of the heat exchanger apparatus of FIG. 14 taken along an axis perpendicular to the longitudinal axis of the heat exchanger apparatus.
Figure 16:
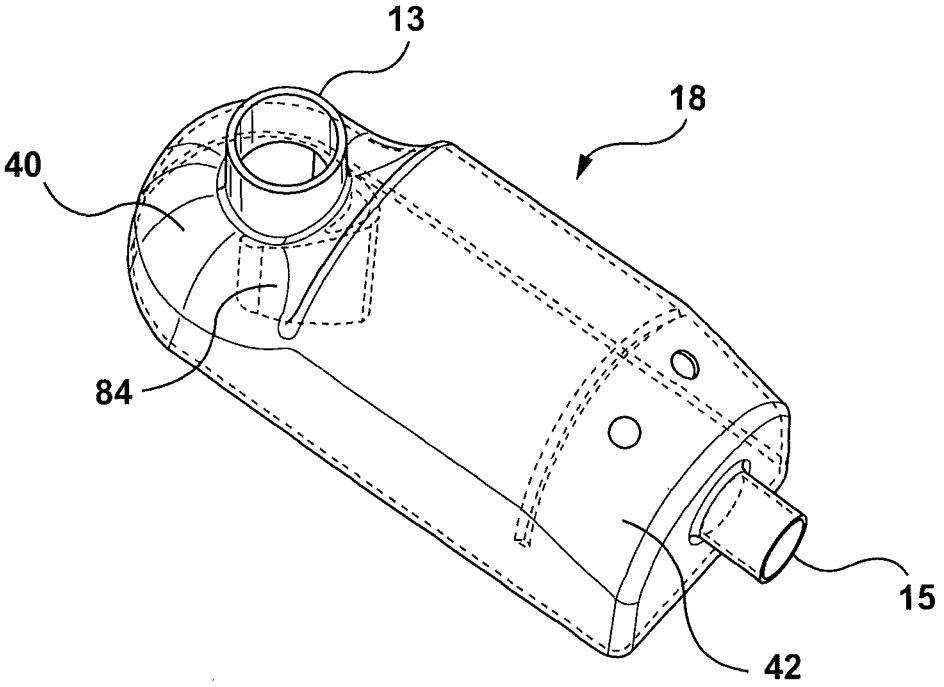
FIG. 16 is a top, perspective view of the cover portion of the heat exchanger apparatus of FIG. 14.

As shown schematically in FIGS. 6, 12 and 13, the first heat exchange fluid enters the open end 76 of the manifold insert 68 and travels downwardly through the central passage of the manifold insert 68 into the first manifold cavity 40. As the fluid exits the second end 74 of the manifold insert 68 it encounters the central protrusion 62 formed in the base plate 16 which serves to divide and/or split the incoming flow around the central protrusion or flow-splitting feature 62. The fluid then travels upwardly along or begins swirling about the curved, concave surfaces of the U-shaped channel region 60 formed in the base plate 16 as well as along the upwardly flared or curved edges 78 of the second end 74 of the manifold insert 68 and through the gap 81 provided between the second end 74 of the manifold insert 68 and the inner surface 63 of the first manifold cavity 40 of the cover portion 18. Once through the gap 81, the fluid may flow along the dome-shaped inner surface 63 of the cover portion 18 as well as along the concave upper surface of the flared edges 78 of the manifold insert 68. The swirling motion that is introduced into the incoming fluid stream by means of the various corresponding curved surfaces provided by the overall manifold structure 100 serves to redirect the incoming fluid towards the inlet end of heat exchanger 12 across a large surface thereof, the fluid generally having desirable fluid dynamic properties that help to ensure appropriate fluid distribution across each channel of the heat exchanger 12 as well as to improve overall heat transfer performance of the heat exchanger apparatus 10. By effectively sandwiching the incoming fluid stream between the concave profile formed in the base plate 16 and the corresponding convex surface of the upwardly flared edges 78 of the manifold insert, the fluid stream is re-directed towards heat exchanger 12 by means of a swirling and/or tortuous fluid pattern as opposed to an abrupt 90 degree turn that is often associated with undesirable pressure drops and/or energy losses.

In order to ensure proper fluid flow through the first manifold cavity 40, an outwardly extending peripheral rib or flange 82 is formed on the outer surface of the tubular body 70 of the manifold insert 68 at about the midway point between the opposed ends 72, 74. However, it will be understood that the peripheral rib or flange 82 may be located at any suitable position along the tubular body 70 and should not be limited to the midway point between the opposed ends 72, 74. The peripheral rib or flange 82 provides a surface for sealing against a portion of the first fluid opening 13 of the cover portion 18 of the flow box 14 to prevent fluid entering the first manifold cavity 40 through the open end 76 of the manifold insert 68 from escaping from the flow box 14 through any gap that may exist between the manifold insert 68 and the first fluid opening 13 formed in the cover portion 18 of the flow box 14.

Figure 10:
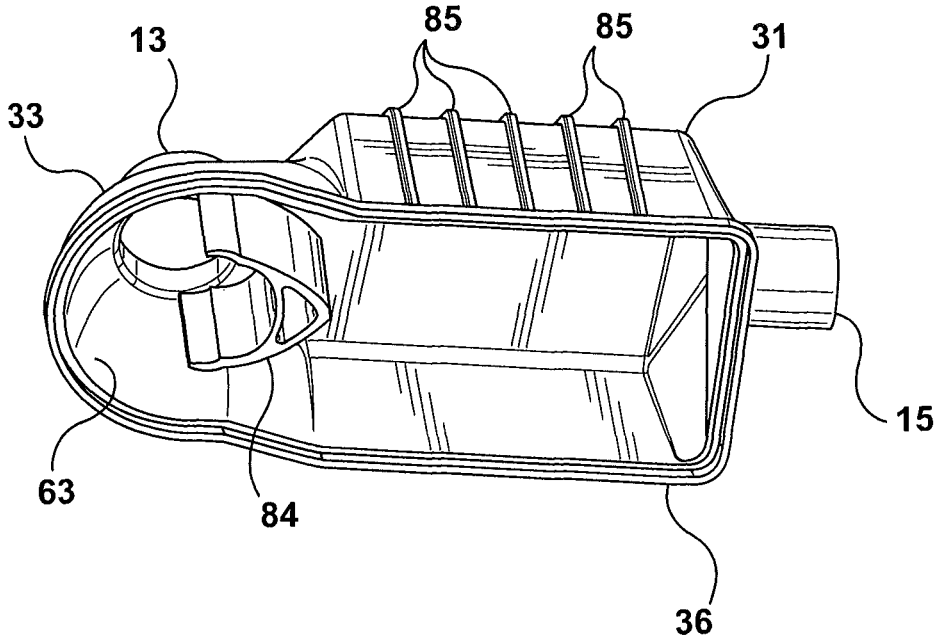
FIG. 10 is a bottom, perspective view of the cover portion of FIG. 7.
Figure 11:
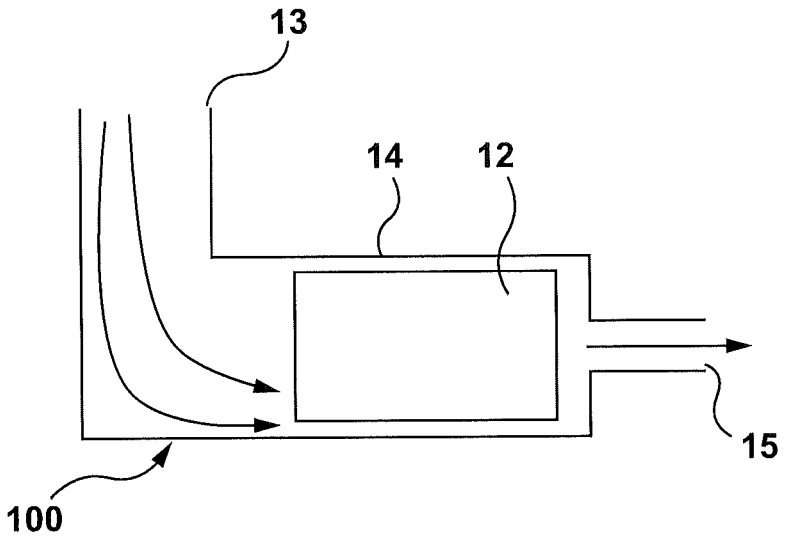
FIG. 11 is a schematic illustration of fluid flow through the heat exchanger apparatus of FIG. 1.
Figure 11A:
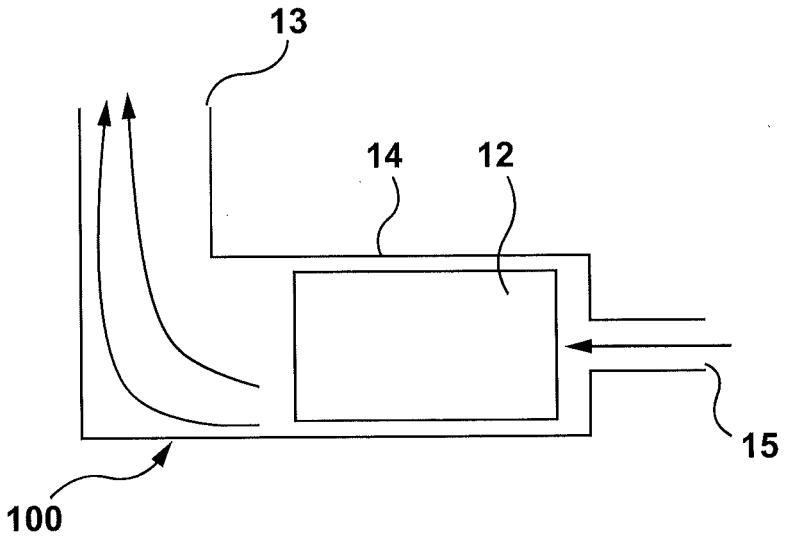
FIG. 11A is a schematic illustration of an alternate fluid flow path through the heat exchanger apparatus of FIG. 1 where the first manifold cavity functions as an outlet manifold.

In order to further enhance the swirling flow within manifold structure 100 and the re-directing of the incoming fluid stream through the flow box inlet or first fluid opening 13 towards heat exchanger 12, the cover portion 18 of the flow box 14 may be provided with a flow barrier 84, as shown for example in FIG. 10.

Flow barrier 84 serves help lock the manifold insert 68 in place against the cover portion 18 and also helps to re-unite the swirling fluid streams that are split by the central protrusion 62 as they are re-directed and funneled towards heat exchanger 12. The overall structure of the cover portion 18 of the flow box 14 is shown in further detail in FIGS. 8-10.

As shown, the cover portion 18 may also be provided with external peripheral ribs 85 to provide added strength to the overall structure depending on the particular application of the heat exchanger apparatus. In some instances, the peripheral ribs 85 may be formed on the inner surface of the cover portion 18 so as to protrude into the open interior space defined by the flow box 14. Having peripheral ribs 85 formed at spaced-apart intervals along the inner surface of the cover portion 18 may be particularly useful in instances where there is a large gap between the inner surface of the cover portion 18 and the outer surface of the heat exchanger 12, the inwardly protruding peripheral ribs 85 therefore serving to prevent bypass flow around the periphery of the heat exchanger 12 as opposed to through the heat exchanger 12 through fluid passages 25.

In the subject exemplary embodiment, base plate 16 may also be provided with an outlet ramp 56 as described above in connection with the example embodiment of FIG. 1-3 for directing fluid exiting fluid passages 25 of heat exchanger 12 towards second fluid opening 15.

Figure 12A:
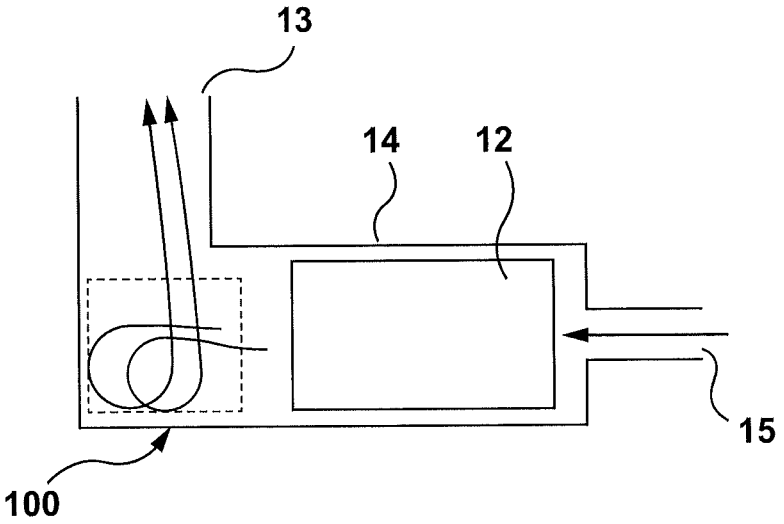
FIG. 12A is a schematic illustration of an alternate fluid flow through the heat exchanger apparatus of FIG. 4 where the first manifold cavity functions as an outlet manifold.

While the above-described exemplary embodiment has been described with the first manifold cavity 40 functioning as an inlet manifold cavity for directing incoming fluid towards the heat exchanger 12 (or other suitable device), it will be understood that the first manifold cavity 40 incorporating the above described features could also serve as an outlet manifold cavity in instances where it is desirable to induce swirling motion or swirl flow into an outgoing fluid stream. In such an embodiment, the fluid would exit the manifold structure 100 through the opening 13 after having been diverted through and/or around the features formed within the first manifold cavity 40 as shown schematically, for example in FIG. 12A. Therefore, it will be understood that the manifold structure 100 is not intended to be limited to an inlet manifold structure and that reference to the manifold structure 100 and first manifold cavity 40 being an inlet manifold is intended to be exemplary.

Referring now to FIGS. 14-17 there is shown another example embodiment of a heat exchanger apparatus 10 incorporating a manifold structure 100 according to the present disclosure. The heat exchanger apparatus 10 shown in FIGS. 14-17 is somewhat similar in structure to the heat exchanger apparatus 10 described above in connection with FIGS. 4-13, however, rather than heat exchanger 12 being in the form of a stacked-plated heat exchanger, heat exchanger 12 is in the form of a conical heat exchanger. For example, in the subject embodiment, heat exchanger 12 is comprised of a plurality of conical-shaped core plates that are alternatingly stacked together in nesting relationship with one another forming mating plate pairs 20. The mating plate pairs 20 form enclosed fluid channels 21 therebetween, the mating plate pairs 20 being spaced-apart from each other to define a second set of fluid passages 25 therebetween. A heat exchanger generally of this type is described in Applicant's U.S. provisional application No. 61/918,188 filed Dec. 19, 2013 entitled "Conical Heat Exchanger", which is hereby incorporated herein by reference.

Figure 17:
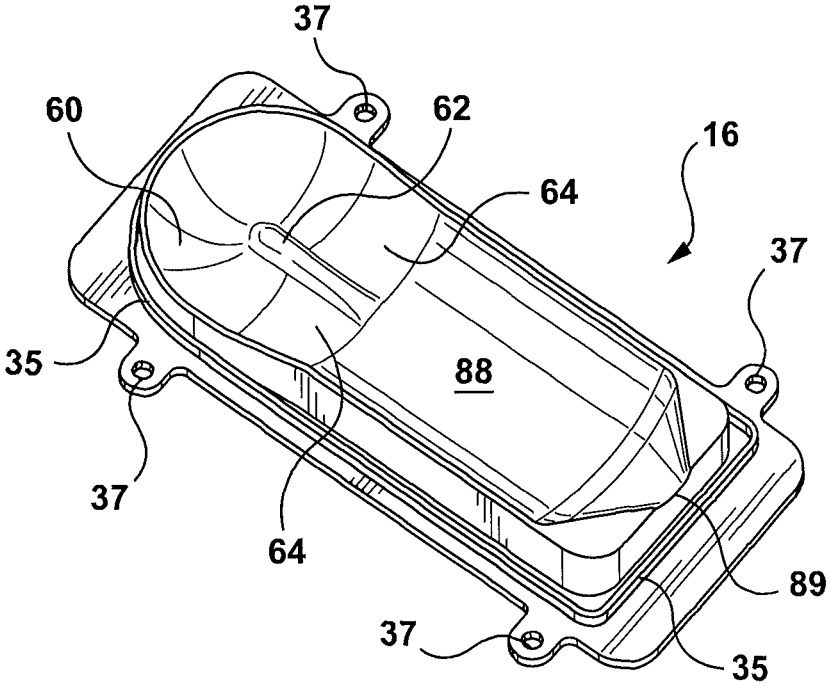
FIG. 17 is a top, perspective view of the base plate of the heat exchanger apparatus of FIG. 14.

As shown more clearly in FIG. 17, the base plate 16 is shaped so as to accommodate the conical shape of heat exchanger 12. Accordingly, rather than providing a central, generally planar portion 30 for receiving a stacked-plate heat exchanger with a generally flat base as in the previously described exemplary embodiments, the base plate 16 is formed with a central curved bed area 88 for receiving the corresponding curved outer surface of conical heat exchanger 12. The outlet end of the base plate 16 is modified so that the curved bed area 88 extends into an upwardly sloping curved conical support surface 89 for receiving the conical or cone-shaped end of the heat exchanger 12. Since the first heat exchange fluid flowing through heat exchanger 12 is funnelled towards a central open passage 89 formed by the stacked conical-shaped plate pairs 20 through fluid passages 25, the fluid exits heat exchanger 12 generally directly in-line with the outlet 15 of flow box 14.

The inlet end of base plate 16 is similar in structure to the previously described embodiment in that a central protrusion 62 or flow-splitting feature with a curved, generally U-shaped channel region 60 formed therearound. Manifold insert 68 is mounted within the first fluid opening 13 of the cover portion 18 of the flow box 14 with the second, flared end 78 extending into the first manifold cavity 40. The convex or upwardly curved flared edges 78 of the second end 74 of the tubular body 70 cooperating with the concave or upwardly curved sidewalls of the U-shaped channel region 60 so as to redirect and/or introduce swirling motion into the incoming fluid stream as it enters the first manifold cavity 40 so as to be redirected towards heat exchanger 12.

In the subject embodiment, rather than having fluid inlet and outlet openings 26, 28 for the second heat exchange fluid being provided in the base plate 16 (as shown for instance in the embodiment of FIG. 5), fluid inlet and outlet openings 26, 28 are formed in the cover portion 18 of the flow box 14 to accommodate appropriate fluid inlet and outlet fittings for heat exchanger 12. In the subject embodiment, the cover portion 18 may also be provided with a fluid barrier 84 as part of the manifold structure 100 as described above in connection with the embodiment of FIG. 10.

As in the previously described embodiments, in operation, fluid entering the heat exchanger apparatus 10 flows through the central passage of manifold insert 68 towards the second end 74 thereof where it impacts on the central protrusion or flow-splitting feature 62. The fluid is then swept upwardly between the corresponding curved surfaces of the channel region 60 formed in the base plate 16 and the upwardly flared edges 78 of the manifold insert 68. The fluid then passes through the gap 81 provided between the upper edges of the channel region in the base plate 16 and the flared edges 78 of the manifold insert 68 where it is directed downwardly around the dome-shaped inner surface 63 of the cover portion 18 and the concave upper surface of the flared edges 78 of the manifold insert 68 creating a swirling movement in the fluid flow as it collects in the inlet manifold cavity before entering the inlet end of heat exchanger 12. Depending upon the particular application, however, it will be understood that the overall flow direction through the apparatus 10 may be reversed with fluid entering the conically shaped heat exchanger 12 through opening 89 via opening 15 provided in the flow box 14 and exiting the heat exchanger 12 through the opposed end thereof and being diverted through the first manifold cavity 40 to opening 13 where it is discharged from the apparatus 10.

While the exemplary embodiments have been described in relation to a heat exchanger apparatus 10 comprising a heat exchanger 12 enclosed within a flow box 14 having a manifold structure 100, it will be understood that the manifold structure 100 may be adapted and incorporated into a variety of heat exchanger and/or fluid devices or systems that require changing the direction of incoming flow by at least 90 degrees while trying to avoid undue or undesirable pressure drops and/or energy losses that often account for decreased performance. By providing a manifold structure 100 having a central inlet passage that discharges towards a manifold cavity comprising generally corresponding concave and convex spaced-apart surfaces that feed into a secondary inlet area, such as the inlet end of a heat exchanger, the incoming fluid stream is re-directed through the at least 90-degree bend while also possibly having swirling movement introduced into the flow stream which may result in desirable fluid dynamic properties being carried through the fluid stream as it travels through the apparatus and/or system or as it is discharged from the apparatus or system in instances where the manifold structure is associated with an outlet manifold cavity. Therefore, while the principal exemplary embodiments have been described in relation to a heat exchanger apparatus it will be understood that the manifold structure according to the present disclosure may be incorporated into a variety of apparatus and/or systems involving the distribution and re-direction of incoming and/or outgoing fluid flow.

Therefore, it will be understood by persons skilled in the art that certain adaptations and modifications of the described embodiments can be made as construed within the scope of the present disclosure. Therefore, the above discussed embodiments are considered to be illustrative and not restrictive.

What is claimed is:

1. A manifold structure comprising:

a first manifold cavity for receiving a fluid;

a first fluid opening in fluid communication with said first manifold cavity, said first fluid opening having a flow axis oriented in a first direction, said first fluid opening located at a first end of said first manifold cavity for inletting or outletting said fluid to or from said first manifold cavity in said first direction;

a second fluid opening in fluid communication with said first manifold cavity, said second fluid opening having a flow axis oriented in a second direction that is generally perpendicular to said first direction, said second fluid opening arranged at a second end of said first manifold cavity for inletting or outletting said fluid to or from said first manifold cavity in said second direction;

a first curved surface forming a bottom portion of said first manifold cavity generally opposite to said first fluid opening having a concave curvature for redirecting the fluid flow from either said first or second direction to the other of said first or second direction;

wherein said manifold structure forms part of a flow box for housing a fluid transmitting device, the flow box comprising:

a base plate defining a generally central region for receiving said fluid transmitting device:

a cover portion arranged on top of said base plate enclosing said fluid transmitting device, said cover portion having a first end and a second end, the cover portion and said base plate together forming said first manifold cavity at one end of said flow box and defining a second manifold cavity at an opposite end of said flow box, wherein said first fluid opening is formed in an upper surface of said cover portion in fluid communication with said first manifold cavity and said second fluid opening is formed in an end wall of said cover portion in fluid communication with said second manifold cavity:

a flow passage interconnecting said first manifold cavity and said second manifold cavity, said fluid transmitting device being disposed in said flow passage:

wherein said first curved surface forms part of the base plate forming a base end of said first manifold cavity generally opposite to said first fluid opening, said first curved surface having a first portion extending towards said first fluid opening and a second portion extending away from said first fluid opening towards the second end of said first manifold cavity defining said concave curvature therebetween, wherein:

said first portion of said first curved surface is in the form of a protrusion extending towards and arranged centrally with respect to said first fluid opening; and said second portion of said first curved surface is in the form of a channel region surrounding said first portion, the channel region having upwardly sloped sidewalls extending away from said first portion, the channel region thereby having a concave curvature.

2. The manifold structure as claimed in claim 1, further comprising:

a second curved surface formed within said first manifold cavity, wherein said second curved surface is spaced-apart from and generally opposite to said first curved surface, said second curved surface being arranged around said protrusion and having one of a concave curvature or a convex curvature.

3. The manifold structure as claimed in claim 2, further comprising:

a manifold insert having a first end and a second end, and a central passage extending therebetween, said manifold insert being mounted within said first fluid opening and extending into said first manifold cavity such that said second end of said manifold insert is spaced-apart from said first curved surface; wherein said second end of said manifold insert defines said second curved surface arranged around and spaced-apart from said protrusion and having a convex curvature; and wherein said first and second curved surfaces cooperate for redirecting the fluid flow from said first direction to said second direction or vice versa.

4. The manifold structure as claimed in claim 1, wherein said first fluid opening is formed in said flow box and is arranged offset with respect to a central longitudinal axis of said fluid transmitting device.

5. The manifold structure as claimed in claim 1, wherein said fluid transmitting device is one of the following alternatives:

a heat exchanger or a humidifier.

6. The manifold structure as claimed in claim 1, further comprising a flow diverting ramp disposed in said second manifold cavity for directing the fluid flow between said second manifold cavity and said second fluid opening.

7. The manifold structure as claimed in claim 1, wherein said base plate further comprises a peripheral rim extending upwardly away from the base plate, the peripheral rim extending around the periphery of the base plate inwardly disposed with respect to a peripheral edge bounding said base plate, the peripheral rim providing a sealing surface for forming a fluid tight seal with said cover portion.

8. A heat exchanger apparatus, comprising:

a housing defining a first manifold cavity and a second manifold cavity and a flow passage interconnecting said first manifold cavity and said second manifold cavity a first fluid opening formed in said housing in fluid communication with said first manifold cavity and having a flow axis oriented in a first direction; a second fluid opening formed in said housing in fluid communication with said second manifold cavity and having a flow axis oriented in a second direction;

a heat exchanger located within the flow passage between the first manifold cavity and the second manifold cavity, the heat exchanger having a plurality of first fluid channels for transmitting a first fluid therethrough in said second direction, and a plurality of second fluid channels for transmitting a second fluid therethrough, the heat exchanger having a first end in fluid communication with said first manifold cavity and a second end in fluid communication with said second manifold cavity;

a first curved surface forming a base end of said first manifold cavity generally opposite to said first fluid opening, said first curved surface having a first portion extending towards said first fluid opening and a second portion extending away from said fluid inlet and defining a concave curvature therebetween;

wherein said first curved surface is a flow diverting surface for redirecting the first fluid flow between one of said first fluid opening or said second fluid opening and the other of said first fluid opening and said second fluid opening from said first or second direction to the other of said first or second direction for transmission to or from said first fluid channels of said heat exchanger; and wherein:

said first portion of said first curved surface is in the form of a protrusion extending towards and arranged centrally with respect to said first fluid opening; and said second portion of said first curved surface is in the form of a channel region surrounding said first portion, the channel region having an upwardly sloped sidewall extending away from said first portion, the channel region thereby having a concave curvature.

9. The heat exchanger apparatus as claimed in claim 8, further comprising:

a second curved surface formed in said first manifold cavity, spaced-apart from and generally opposite to said first curved surface and arranged so as to encircle the first portion of said first curved surface and having one of a convex curvature or a concave curvature.

10. The heat exchanger apparatus as claimed in claim 9, further comprising:

a manifold insert having a first end and a second end, and a central passage extending therebetween, said manifold insert being mounted within said first fluid opening and extending into said first manifold cavity such that said second end of said manifold insert is spaced-apart from said first curved surface;

wherein said second end of said manifold insert defines said second curved surface, said second curved surface having a convex curvature; and wherein said first and second curved surfaces cooperate for redirecting the first fluid flow from said first direction to said second direction or vice versa.

11. The heat exchanger apparatus as claimed in claim 8, wherein said housing comprises:

a base plate defining said first curved surface and a central, generally planar portion for receiving said heat exchanger;

a cover portion arranged on top of said base plate enclosing said heat exchanger, the cover portion having a first end and a second end, the base plate and the cover portion together forming said first manifold cavity and said second manifold cavity;

wherein said first fluid opening is formed in a top surface of said cover portion and arranged offset with respect to a central longitudinal axis of said heat exchanger proximal to a corner of said first end of said heat exchanger; and wherein said first end of said cover portion is contoured around said first fluid opening and tapers outwardly from said first fluid opening to an adjacent corner of the first end of said heat exchanger.

12. The heat exchanger apparatus as claimed in claim 8, wherein said housing comprises:

a base plate defining said first curved surface and a central, generally planar portion for receiving said heat exchanger;

a cover portion arranged on top of said base plate enclosing said heat exchanger, the cover portion having a first end and a second end, the base plate and the cover portion together forming said first manifold cavity and said second manifold cavity;

wherein said cover portion further comprises a plurality of peripheral ribs arranged at spaced apart intervals along a length of the cover portion, said peripheral ribs protruding inwardly about said heat exchanger for preventing bypass flow around a periphery of the heat exchanger within the flow passage of said housing; and wherein said base plate further comprises a peripheral rim extending upwardly away from the base plate, the peripheral rim extending around the periphery of the base plate inwardly disposed with respect to a peripheral edge bounding said base plate, the peripheral rim providing a sealing surface for providing a fluid tight seal with said cover portion.

13. The heat exchanger apparatus as claimed in claim 12, wherein said first fluid opening is formed in a top surface of said cover portion and arranged generally in line with a central longitudinal axis of said heat exchanger; and wherein said first end of said cover portion is dome shaped and cooperates with said first curved surface for re-directing the first fluid flow along said first and second directions through said first manifold cavity, said heat exchanger further comprising:

a manifold insert having a first end and a second end, and a central passage extending therebetween, said manifold insert being mounted within said first fluid opening and extending into said first manifold cavity such that said second end of said manifold insert is spaced-apart from said first curved surface;

wherein said second end of said manifold insert defines a second curved surface generally opposed to said first curved surface, said second curved surface having a convex curvature; and wherein said first and second curved surfaces and said dome-shaped first end of said cover portion cooperate for redirecting the first fluid flow through said first manifold cavity between said first and second directions through a swirl or loop of about 270 degrees.

14. The heat exchanger apparatus as claimed in claim 8, wherein: said heat exchanger is a conical heat exchanger; and wherein said housing comprises:

a base plate defining said first curved surface; and a cover portion arranged on top of said base plate enclosing said conical heat exchanger, said cover portion having a first end and a second end;

wherein said base plate further comprises a curved support bed area for receiving a corresponding curved outer surface of the conical heat exchanger, the heat exchanger being arranged intermediate said first and second ends of said cover portion on said curved support bed.

15. The heat exchanger apparatus as claimed in claim 8, further comprising a control device mounted on said housing in fluid communication with said first fluid opening for controlling flow to or from said first fluid opening and said first manifold cavity.

16. The manifold structure as claimed in claim 5, wherein said heat exchanger is self-enclosing.

* * * * *